US009113247B2

(12) United States Patent
Chatlani et al.

(10) Patent No.: US 9,113,247 B2
(45) Date of Patent: Aug. 18, 2015

(54) DEVICE AND METHOD FOR DIRECTION DEPENDENT SPATIAL NOISE REDUCTION

(75) Inventors: Navin Chatlani, Antibes (FR); Eghart Fischer, Schwabach (DE)

(73) Assignee: Sivantos Pte. Ltd., Singapore (SG)

( * ) Notice: Subject to any disclaimer, the term of this patent is extended or adjusted under 35 U.S.C. 154(b) by 402 days.

(21) Appl. No.: 13/579,984

(22) PCT Filed: Oct. 20, 2010

(86) PCT No.: PCT/EP2010/065801

§ 371 (c)(1),
(2), (4) Date: Nov. 5, 2012

(87) PCT Pub. No.: WO2011/101045

PCT Pub. Date: Aug. 25, 2011

(65) Prior Publication Data

US 2013/0208896 A1 Aug. 15, 2013

(30) Foreign Application Priority Data

Feb. 19, 2010 (EP) ..... 10154098

(51) Int. Cl.
*H04R 3/00* (2006.01)
*H04R 5/04* (2006.01)
*H04R 25/00* (2006.01)

(52) U.S. Cl.
CPC ..... *H04R 5/04* (2013.01); *H04R 25/407* (2013.01); *H04R 25/552* (2013.01); *H04R 2201/401* (2013.01); *H04R 2410/01* (2013.01); *H04R 2430/21* (2013.01)

(58) Field of Classification Search
CPC ..... H04R 5/00; H04R 3/00; H04R 1/02; H04R 25/00; H04R 3/005; H04R 25/405
USPC ..... 381/91–92, 17, 26, 312–313, 317
See application file for complete search history.

(56) References Cited

U.S. PATENT DOCUMENTS 8,027,495 B2 * 9/2011 Roeck ..... 381/312

(Continued)

FOREIGN PATENT DOCUMENTS

CN 1333994 A 1/2002
CN 1575042 A 2/2005

(Continued)

OTHER PUBLICATIONS

Robert W. Baeuml, et al. "Uniform Polyphase Filter Banks for Use in Hearing Aids: Design and Constraints", 16th European Signal Processing Conference (EUSIPCO 2008), Lausanne, Switzerland, Aug. 25-29, 2008, copyright by EURASIP.

(Continued)

*Primary Examiner* — Disler Paul
(74) *Attorney, Agent, or Firm* — Laurence A. Greenberg; Werner H. Stemer; Ralph E. Locher

(57) ABSTRACT

A device and a method reduce direction dependent spatial noise. The device includes a plurality of microphones for measuring an acoustic input signal from an acoustic source. The plurality of microphones form at least one monaural pair and at least one binaural pair. Directional signal processing circuitry is provided for obtaining, from the input signal, at least one monaural directional signal and at least one binaural directional signal. A target signal level estimator estimates a target signal level by combining at least one of the monaural directional signals and at least one of the binaural directional signals, which at least one monaural directional signal and at least one binaural directional signal mutually have a maximum response in a direction of the acoustic source. A noise signal level estimator estimates a noise signal level by combining at least one of the monaural directional signals and at least one of the binaural directional signals, which at least one monaural directional signal and at least one binaural directional signal mutually have a minimum sensitivity in the direction of the acoustic source.

16 Claims, 9 Drawing Sheets

(56) References Cited

U.S. PATENT DOCUMENTS

| | | | | |
|---|---|---|---|---|
| 8,126,153 | B2 * | 2/2012 | Fischer | 381/23.1 |
| 8,139,787 | B2 | 3/2012 | Haykin et al. | |
| 8,483,416 | B2 * | 7/2013 | Roeck et al. | 381/313 |
| 8,600,086 | B2 | 12/2013 | Jensen et al. | |
| 2004/0175005 | A1 * | 9/2004 | Roeck | 381/74 |
| 2005/0025325 | A1 | 2/2005 | Fischer | |
| 2006/0198529 | A1 * | 9/2006 | Kjems et al. | 381/26 |
| 2009/0238385 | A1 | 9/2009 | Fischer | |
| 2010/0002886 | A1 | 1/2010 | Doclo et al. | |
| 2010/0020995 | A1 | 1/2010 | Elmedyb et al. | |
| 2011/0144779 | A1 * | 6/2011 | Janse et al. | 700/94 |
| 2012/0128164 | A1 | 5/2012 | Blamey | |

FOREIGN PATENT DOCUMENTS

| | | | |
|---|---|---|---|
| WO | 0030404 | A | 5/2000 |
| WO | 2005029914 | A1 | 3/2005 |
| WO | 2007028250 | A2 | 3/2007 |
| WO | 2007128825 | A1 | 11/2007 |
| WO | 2009072040 | A1 | 6/2009 |
| WO | 2010022456 | A1 | 3/2010 |

OTHER PUBLICATIONS

Marc Ihle, "Differential Microphone Arrays for Spectral Subtration", International Workshops on Acoustic Echo and Noise Control (IWAENC 2003), Sep. 2003, Kyoto, Japan, p. 259-262.

T. Rohdenburg, V. Hohmann, B. Kollmeier, "Robustness Analysis of Binaural Hearing Aid Beamformer Algorithms by Means of Objective Perceptual Quality Measures", in 2007 IEEE Workshops on Application of Signal Processing to Audio and Acoustics, p. 315-318, Oct. 2007.

S. Doclo, M. Moonen, T. Van den Bogaert, J. Wouters, "Reduced-Bandwidth and Distributed MWF-Based Noise Reduction Algorithms for Binaural Hearing Aids", IEEE Transactions on Audio, Speech and Language Processing, vol. 17, No. 1, pp. 38-51, Jan. 2009.

H. Teutsch, G. Elko, "First and Second Order Differential Microphone Arrays", in 7th International Workshops on Acoustic Echo and Noise Control (IWAENC 2001), p. 35-38, Sep. 2001.

S. Srinivasan, A. C. den Brinker, "Analyzing Rate-Constrained Beamforming Schemes in Wireless Binaural Hearing Aids", in 17th European Signal Processing Conference (EUSIIPCO), Aug. 2009.

N. Chatlani, J. J. Soraghan, "EMD-Based Noise Estimation and Tracking (ENET) With Application to Speech Enhancement", in 17th European Signal Processing Conference (EUSPCO), Aug. 2009.

DeBrunner et al: "A Directional Adaptive Least-Mean-Square Acoustic Array for Hearing Aid Enhancement", The Journal of the Acoustical Society of America, American Institute of Physics for the Acoustical Society of America, New York, NY, US, vol. 98, No. 1, Jul. 1, 1995, pp. 437-444, XP000523188, ISSN: 0001-4966.

Henning Puder: "Acoustic noise control: An overview of several methods based on applications in hearing aids", Communications, Computers and Signal Processing, 2009. PACRIM 2009. IEEE Pacific Rim Conference on, IEEE, Piscataway, NJ, USA, Aug. 23, 2009, pp. 871-876, XP031549144, ISBN: 978-1-4244-4560-8.

Chatlani et al: :Speech Enhancement using Adaptive Empirical Mode Decomposition in 16th International Conference on Digital Sig. Proc. (DSP 2009), Jul. 2009.

Van Den Bogaert et al., "Speech enhancement with multichannel Wiener filter techniques in multimicrophone binaural aids", Journal of the Acoustical Society of America, vol. 125, No. 1, Jan. 2009, pp. 360-371, XP-002702378.

* cited by examiner

DEVICE AND METHOD FOR DIRECTION DEPENDENT SPATIAL NOISE REDUCTION

BACKGROUND OF THE INVENTION

Field of the Invention

The present invention relates to direction dependent spatial noise reduction, for example, for use in binaural hearing aids.

For non-stationary signals such as speech in a complex hearing environment with multiple speakers, directional signal processing is vital to improve speech intelligibility by enhancing the desired signal. For example, traditional hearing aids utilize simple differential microphones to focus on targets in front or behind the user. In many hearing situations, the desired speaker azimuth varies from these predefined directions. Therefore, directional signal processing which allows the focus direction to be steerable would be effective at enhancing the desired source.

Recently approaches for binaural beamforming have been presented. In

T. Rohdenburg, V. Hohmann, B. Kollmeier, "Robustness Analysis of Binaural Hearing Aid Beamformer Algorithms by Means of Objective Perceptual Quality Measures," in 2007 IEEE Workshop on Applications of Signal Processing to Audio and Acoustics, pp. 315-318, October 2007 a binaural beamformer was designed using a configuration with two 3-channel hearing aids. The beamformer constraints were set based on the desired look direction to achieve a steerable beam with the use of three microphones in each hearing aid which is impractical in state of the art hearing aids. The system performance was shown to be dependent on the propagation model used in formulating the steering vector. Binaural multi-channel Wiener filtering (MWF) was used in S. Doclo, M. Moonen, T. Van den Bogaert, J. Wouters, "Reduced-Bandwidth and Distributed MWF-Based Noise Reduction Algorithms for Binaural Hearing Aids," IEEE Transactions on Audio, Speech, and Language Processing, vol. 17, no. 1, pp. 38-51, January 2009 to obtain a steerable beam by estimating the statistics of the speech signal in each hearing aid. MWF is computationally expensive and the results presented were achieved using a perfect VAD (voice activity detection) to estimate the noise while assuming the noise to be stationary during speech activity. Another technique for forming one spatial null in a desired direction has been shown in M. Ihle, "Differential Microphone Arrays for Spectral Subtraction", in Intl Workshop on Acoustic Echo and Noise Control (IWAENC 2003), September 2003 but is sensitive to the microphone array geometry and therefore not applicable to a hearing aid setup.

BRIEF SUMMARY OF THE INVENTION

The object of the present invention is to provide a device and method for direction dependent spatial noise reduction that can be used to focus the angle of maximum sensitivity to a target acoustic source at any given azimuth, i.e., also to directions other than 0° (i.e., directly in front of the user) or 180° (i.e., directly behind the user).

The above object is achieved by the method according to claim 1 and the device according to claim 8.

The underlying idea of the present invention lies in the manner in which the estimates of the target signal level and the noise signal level are obtained, so as to focus on a desired acoustic source at any arbitrary direction. The target signal power estimate is obtained by combination of at least two directional outputs, one monaural and one binaural, which mutually have maximum response in the direction of the signal. The noise signal power estimate is obtained by measuring the maximum power of at least two directional signals, one monaural and one binaural, which mutually have minimum sensitivity in the direction of the desired source. An essential feature of the present invention thus lies in the combination of monaural and binaural directional signals for the estimation of the target and noise signal levels.

In one embodiment, to obtain the desired target signal level in the direction of the acoustic signal source, the proposed method further comprises estimating the target signal level by selecting the minimum of the at least one monaural directional signal and the at least one binaural directional signal, which mutually have a maximum response in a direction of the acoustic source.

In one embodiment, to steer the beam in the direction of the acoustic source, the proposed method further comprises estimating the noise signal level by selecting the maximum of the at least one monaural directional signal and the at least one binaural directional signal, which mutually have a minimum sensitivity in the direction of the acoustic source.

In an alternate embodiment, the proposed method further comprises estimating the noise signal level by calculating the sum of the at least one monaural directional signal and the at least one binaural directional signal, which mutually have a minimum sensitivity in the direction of the acoustic source.

In a further embodiment, the proposed method further comprises calculating, from the estimated target signal level and the estimated noise signal level, a Wiener filter amplification gain using the formula:

$$\text{amplification gain} = \text{target signal level} / [\text{noise signal level} + \text{target signal level}].$$

Applying the above gain to the input signal produces an enhanced signal output that has reduced noise in the direction of the acoustic source.

In a contemplated embodiment, since the response of directional signal processing circuitry is a function of acoustic frequency, the acoustic input signal is separated into multiple frequency bands and the above-described method is used separately for multiple of said multiple frequency bands.

In various different embodiments, for said signal levels one or multiple of the following units are used: power, energy, amplitude, smoothed amplitude, averaged amplitude, absolute level.

BRIEF DESCRIPTION OF THE SEVERAL VIEWS OF THE DRAWING

The present invention is further described hereinafter with reference to illustrated embodiments shown in the accompanying drawings, in which:

FIG. 6A shows the output when side_select=1. FIG. 6B shows the output when side_select=0.

FIG. 6C shows the output when plane_select=1. FIG. 6D shows the output when plane_select=0.

FIG. 9A illustrates the pattern for a beam steered to left side at 250 Hz. FIG. 9B illustrates the pattern for a beam steered to left side at 2 kHz. FIG. 9C illustrates the pattern for a beam steered to 45° at 250 Hz. FIG. 9D illustrates the pattern for a beam steered to 45° at 500 Hz

DESCRIPTION OF THE INVENTION

Figure 1:
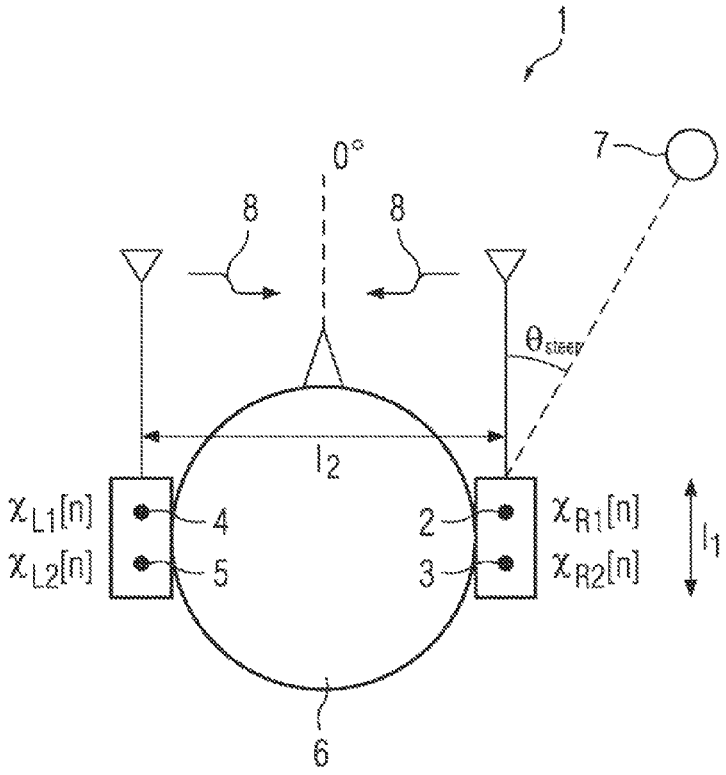
FIG. 1 illustrates a binaural hearing aid set up with wireless link, where embodiments of the present invention may be applicable.

Embodiments of the present invention discussed herein below provide a device and a method for direction dependent spatial noise reduction, which may be used in a binaural hearing aid set up 1 as illustrated in FIG. 1. The set up 1 includes a right hearing aid comprising a first pair of monaural microphones 2, 3 and a left hearing aid comprising a second pair of monaural microphones 4, 5. The right and left hearing aids are fitted into respective right and left ears of a user 6. The monaural microphones in each hearing aid are separated by a distance $l_1$, which may, for example, be approximately equal to 10 mm due to size constraints. The right and left hearing aids are separated by a distance $l_2$ and are connected by a bi-directional audio link 8, which is typically a wireless link. To minimize power consumption, only one microphone signal may be transmitted from one hearing aid to the other. In this example, the front microphones 2 and 4 of the left and right hearing aids respectively form a binaural pair, transmitting signals by the audio link 8. In FIG. 1, $x_{R1}[n]$ and $x_{R2}[n]$ represent $n^{th}$ omni-directional signals measured by the front microphone 2 and back microphone 3 respectively of the right hearing aid, while $x_{L1}[n]$ and $x_{L2}[n]$ represent $n^{th}$ omni-directional signals measured by the front microphone 4 and back microphone 5 respectively of the left hearing aid. The signals $x_{R1}[n]$ and $x_{L1}[n]$ thus respectively correspond to the signals transmitted from the respective front microphones 2 and 4 of the right and left hearing aids.

The monaural microphone pairs 2, 3, and 4, 5 each provide directional sensitivity to target acoustic sources located directly in front of or behind the user 6. With the help of the binaural microphones 2 and 4, side-look beam steering is realized which provides directional sensitivity to target acoustic sources located to sides (left or right) of the user 6. The idea behind the present invention is to provide direction dependent spatial noise reduction that can be used to focus the angle of maximum sensitivity of the hearing aids to a target acoustic source 7 at any given azimuth P steer that includes angles other than 0°/180° (front and back direction) and 90°/270° (right and left sides).

In precedence to the discussion on the embodiments of the proposed invention, the following sections discuss how monaural directional sensitivity (for front and back directions) and binaural side look steering (for left and right sides) are achieved.

Directional sensitivity is achieved by directional signal processing circuitry, which generally includes differential microphone arrays (DMA). A typical first order DMA circuitry 22 is explained referring to FIG. 2. Such first order DMA circuitry 22 is generally used in traditional hearing aids that include two omni-directional microphones 23 and 24 separated by a distance l (approx. 10 mm) to generate a directional response. This directional response is independent of frequency as long as the assumption of small spacing l to acoustic wavelength λ, holds. In this example, the microphone 23 is considered to be on the focus side while the microphone 24 is considered to be on the interferer side. The DMA 22 includes time delay circuitry 25 for delaying the response of the microphone 24 on the interferer side by a time interval T. At the node 26, the delayed response of the microphone 24 is subtracted from the response of the microphone 23 to yield a directional output signal y[n]. For a signal x[n] impinging on the first order DMA 22 at an angle θ, under farfield conditions, the magnitude of the frequency and angular dependent response of the DMA 22 is given by:

$$|H(\Omega,\theta)| = \left|1 - e^{-j\Omega\left(T+\frac{l}{c}\cos\theta\right)}\right| \tag{1}$$

where c is the speed of sound.

The delay T may be adjusted to cancel a signal from a certain direction to obtain the desired directivity response. In hearing aids, this delay T is fixed to match the microphone spacing l/c and the desired directivity response is instead achieved using a back-to-back cardioid system as shown in the adaptive differential microphone array (ADMA) 27 in FIG. 3. As shown, the ADMA circuitry 27 includes time delay circuitry 30 and 31 for delaying the responses from the microphones 28 and 29 that are spaced apart by a distance l. $C_F$ is the cardioid beamformer output obtained from the node 33 that attenuates signals from the interferer direction and $C_R$ is the anti-cardioid (backward facing cardioid) beamformer output obtained from the node 32 which attenuates signals from the focus direction. The anti-cardioid beamformer output $C_R$ is multiplied by a gain β and subtracted from the cardioid beamformer output $C_F$ at the node 35, such that the array output y[n] is given by:

$$y[n]=C_F-\beta C_R \tag{2}$$

For y[n] from equation (2), the signal from 0° is not attenuated and a single spatial notch is formed in the direction $\theta_1$ for a value of β given by:

$$\theta_1 = \arccos\frac{\beta-1}{\beta+1} \tag{3}$$

In ADMA for hearing aids, the parameter β is adapted to steer the notch to direction $\theta_1$ of a noise source to optimize the directivity index. This is performed by minimizing the MSE of the output signal y[n]. Using a gradient descent technique to follow the negative gradient of the MSE cost function, the parameter β is adapted by equation (4) expressed as:

$$\beta[n+1] = \beta[n] - \mu\frac{\delta}{\delta\beta}\varepsilon(y^2[n]) \tag{3}$$

In hearing situations, when a desired acoustic source is on one side of the user, side-look beam steering is realized using binaural hearing aids with a bidirectional audio link. It is known that at high frequencies, the Interaural Level Difference (ILD) between measured signals at both sides of the head is significant due to the head-shadowing effect. The ILD increases with frequency. This head-shadow effect may be exploited in the design of the binaural Wiener filter for the higher frequencies. At lower frequencies, the acoustic wavelength $\lambda$s is long with respect to the head diameter. Therefore, there is minimal change between the sound pressure levels at both sides of the head and the Interaural Time Difference (ITD) is found to be the more significant acoustic cue. At lower frequencies, a binaural first-order DMA is designed to create the side-look. Therefore, the problem of side-look steering may decomposed into two smaller problems with a binaural DMA for the lower frequencies and a binaural Wiener filter approach for the higher frequencies as illustrated by a side-look steering system 36 in FIG. 3. Herein, the input noisy input signal x[n] is given by:

$$x[n]=s[n]+d[n] \tag{4}$$

where s[n] is the target signal from direction $\theta_s \in [90°\text{-}90°]$, which corresponds to the focus side, and d[n] is the noise signal incident from direction $\theta_d$ (where $\theta_d=-\theta_s$), which corresponds to the interferer side.

The input signal x[n] is decomposed into frequency sub-bands by an analysis filter-bank 37. The decomposed sub-band signals are separately processed by high frequency-band directional signal processing module 38 and low frequency-band directional signal processing module 39, the former incorporating a Wiener filter and the latter incorporating DMA circuitry. Finally, a synthesis filter-bank 40 reconstructs an output signal ŝ[n] that is steered in the direction $\theta_s$ of the focus side.

At the high frequency-band directional signal processing module 38, the head shadowing effect is exploited in the design of a binaural system to perform the side-look at higher frequencies (for example for frequencies greater than 1 kHz). The signal from the interferer side is attenuated across the head at these higher frequencies and the analysis of the proposed system is given below.

Considering a scenario where a target signal s[n] arrives from the left side (−90°) of the hearing aid user and an interferer signal d[n] is on the right side (90°), from FIG. 1, the signal $x_{L1}[n]$ recorded at the front left microphone and the signal $x_{R,1}[n]$ recorded at the front right microphone are given by:

$$x_{L1}[n]=s[n]+h_{L1}[n]*d[n] \tag{5}$$

$$x_{R1}[n]=h_{R1}[n]*s[n]+d[n] \tag{6}$$

where $h_{L1}[n]$ is the transfer function from the front right microphone to the left front microphone and $h_{R1}[n]$ is the transfer function from the front left microphone to the front right microphone. Transformation of equations (5) and (6) into the frequency domain gives:

$$X_{L1}(\Omega)=S(\Omega)+H_{L1}(\Omega)*D(\Omega) \tag{7}$$

$$X_{R1}(\Omega)=H_{R1}(\Omega)*S(\Omega)+D(\Omega) \tag{8}$$

Let the short-time spectral power of signal $X_a(\Omega)$ be denoted as $\Phi_\alpha(\Omega)$. Since the left side is the focus side and the right side is the interferer side, a classical Wiener filter can be derived as:

$$W(\Omega)=\frac{\Phi_{X_{t,1}}(\Omega)}{\Phi_{X_{t,1}}(\Omega)+\Phi_{X_{R,1}}(\Omega)} \tag{9}$$

For analysis purposes, it is assumed that $\Phi_{H_L}(\Omega)=\Phi_{H_R}(\Omega)=\alpha(\Omega)$. $\alpha(\Omega)$ is the frequency dependent attenuation corresponding to the transfer function from one hearing aid to the other across the head. Therefore (9) can be simplified to:

$$W(\Omega)=\frac{\Phi_S(\Omega)+\alpha(\Omega)\Phi_D(\Omega)}{(1+\alpha(\Omega))(\Phi_S(\Omega)+\Phi_D(\Omega))} \tag{10}$$

As explained earlier, at higher frequencies the ILD attenuation $\alpha(\Omega)\rightarrow 0$ due to the head-shadowing effect and equation (10) tends to a traditional Wiener filter. At lower frequencies, the attenuation $\alpha(\Omega)\rightarrow 1$ and the Wiener filter gain $W(\Omega)\rightarrow 0.5$. The output filtered signal at each side of the head is obtained by applying the gain $W(\Omega)$ to the omni-directional signals at the front microphones on both hearing aid sides. If X is defined as the vector $[X_{L1}(\Omega)\ X_{R1}(\Omega)]$ and the output from both hearing aids is denoted as $Y=[Y_{L1}(\Omega)\ Y_{R1}(\Omega)]$, then Y is given by:

$$Y=W(\Omega)X \tag{11}$$

Thus, the spatial impression cues from the focused and interferer sides are preserved since the gain is applied to the original microphone signals on either side of the head.

At lower frequencies, the signal's wavelength is small compared to the distance $l_2$ across the head between the two hearing aids. Therefore spatial aliasing effects are not significant. Assuming $l_2$=17 cm, the maximum acoustic frequency to avoid spatial aliasing is approximately 1 kHz.

Figure 3:
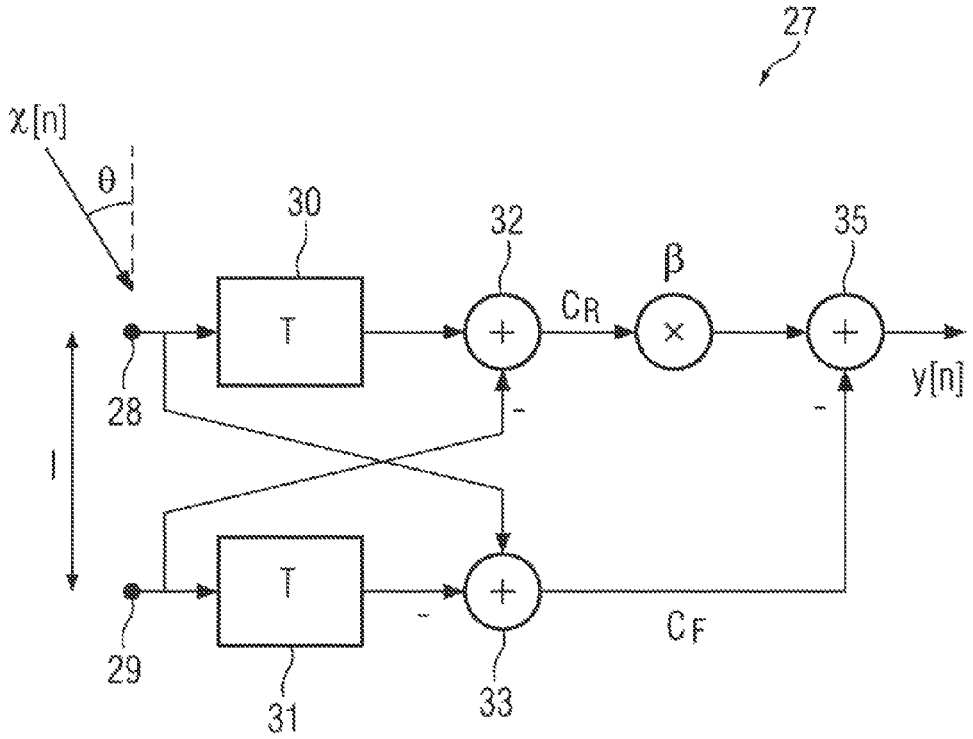
FIG. 3 is a block diagram illustrating an adaptive differential microphone array circuitry.

Referring back to FIG. 3, the low frequency-band directional signal processing module 39 incorporates a first-order ADMA across the head, wherein the left side is the focused side of the user and the right side is the interferer side. An ADMA, of the type illustrated in FIG. 3, is accordingly designed so as to perform directional signal processing to steer to the side of interest. Thus in this case, a binaural first order ADMA is implemented along the microphone sensor axis pointing to −90° across the head. Two back-to-back cardioids are thus resolved setting the delay to $l_2/c$ where c is the speed of sound. The array output is a scalar combination of a forward facing cardioid $C_F[n]$ (pointing to −90°) and a backward facing cardioid $C_B[n]$ (pointing to 90°) as expressed in equation (2) above.

Figure 2:
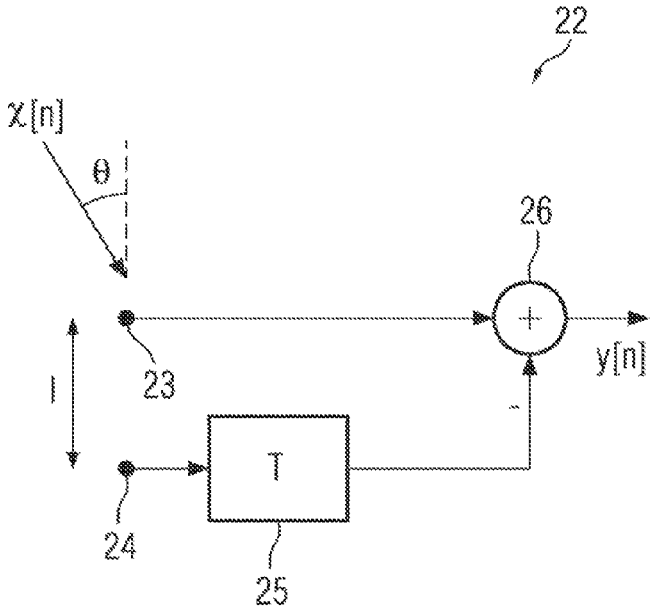
FIG. 2 is a block diagram illustrating a first order differential microphone array circuitry.
Figure 4:
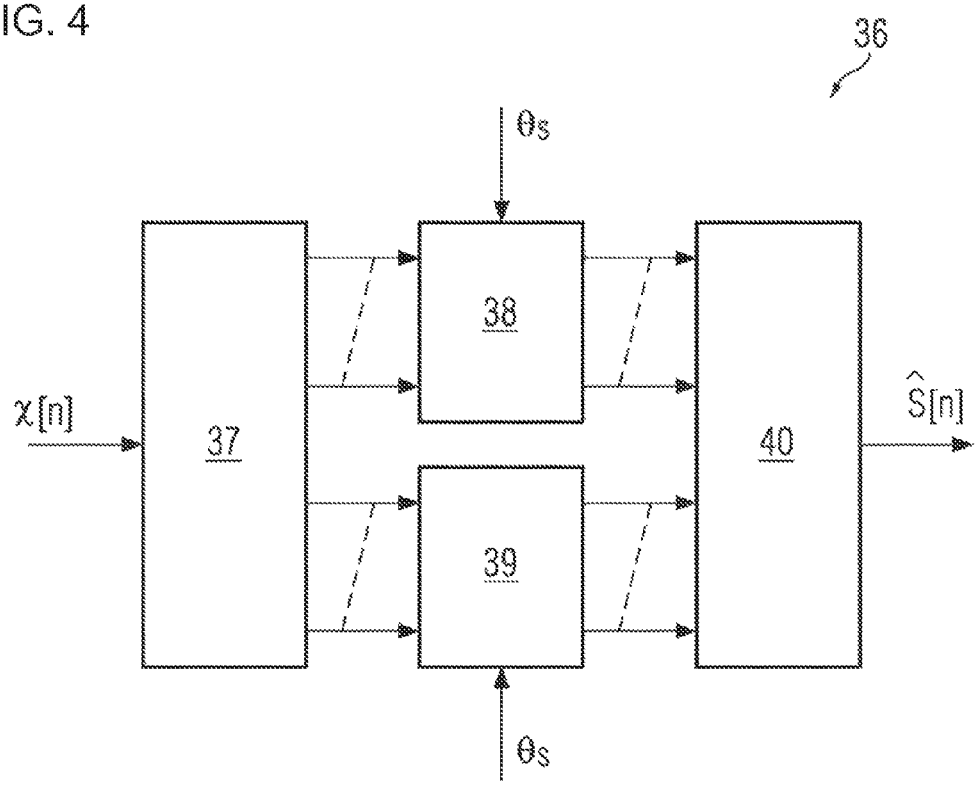
FIG. 4 is a block diagram of a side-look steering system.

Thus, it is seen that beam steering to 0° and 180° may be achieved using the basic first order DMA illustrated in FIGS. 2-3 while beam steering to 90° and 270° may be achieved by a system illustrating in FIG. 4 incorporating a first order DMA for low frequency band directional signal processing and a Wiener filter for high frequency directional signal processing.

Embodiments of the present invention provide a steerable system to achieve specific look directions $\theta_{d,n}$ where:

$$\theta_{d,n}=45*n°\forall n=0,\ldots 7 \tag{12}$$

To that end, a parametric model is proposed for focusing the beam to the subset of angles $\theta_{steer} \subset \theta_{d,n}$ where $\theta_{steer} \in$ [45°, 135°, 225°, 315°]. This model may be used to derive an estimate of the desired signal and an estimate of the interfering signal for enhancing the input noisy signal.

Figure 5:
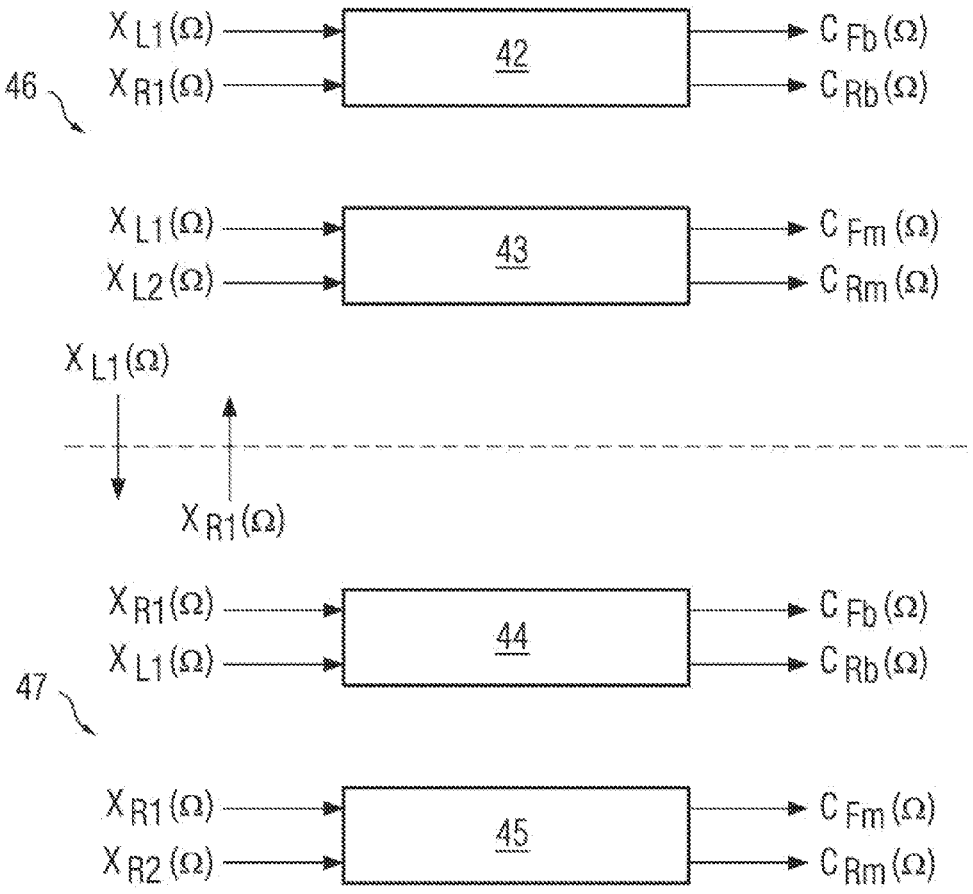
FIG. 5 is a schematic diagram illustrating a steerable binaural beamformer in accordance with the present invention.

The desired signal incident from angle $\theta_{steer}$ and the interfering signal are estimated by a combination of directional signal outputs. The directional signals used in this estimation are derived as shown in FIG. 5. In FIG. 5, the inputs $X_{L1}(\Omega)$ and $X_{L2}(\Omega)$ correspond to omni-directional signals measured by the front and back microphones respectively of the left hearing aid 46. The inputs $X_{R1}(\Omega)$ and $X_{R2}(\Omega)$ correspond to omni-directional signals measured by the front and back microphones respectively of the right hearing aid 47. The binaural DMA 42 and the monaural DMA 43 correspond to the left hearing aid 46 while the binaural DMA 44 and the monaural DMA 45 correspond to the right hearing aid 47. The outputs $C_{Fb}(\Omega)$ and $C_{Rb}(\Omega)$ result from the binaural first order DMAs 42 and 44 and respectively denote the forward facing and backward facing cardioids. The outputs $C_{Fm}(\Omega)$ and $C_{Rm}(\Omega)$ result from the monaural first order DMAs 43 and 45 and follow the same naming convention as in the binaural case.

Figure 6A:
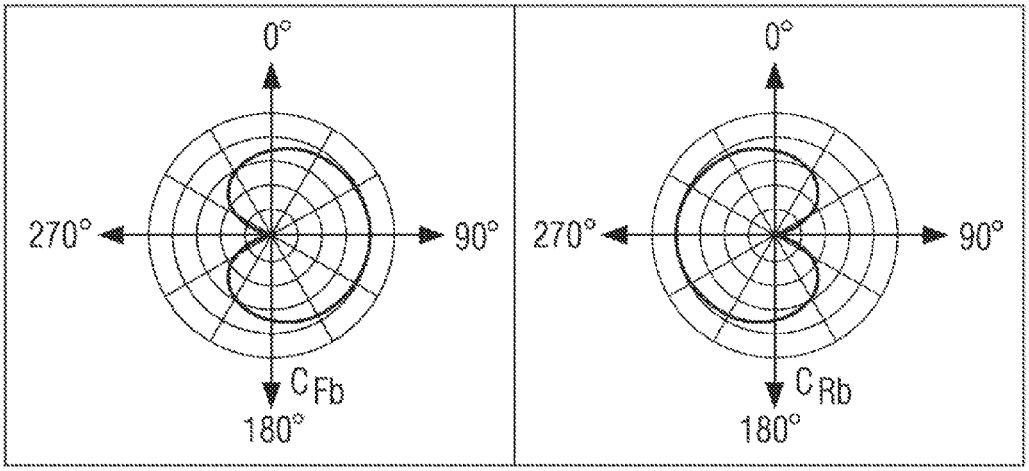
FIGS. 6A-6D illustrate differential microphone array outputs for monaural and binaural cases.
Figure 6B:
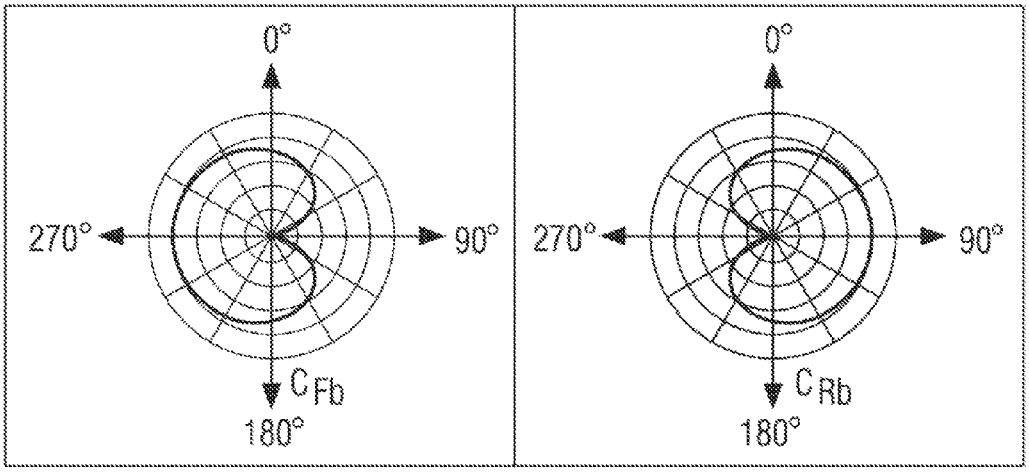
Figure 6C:
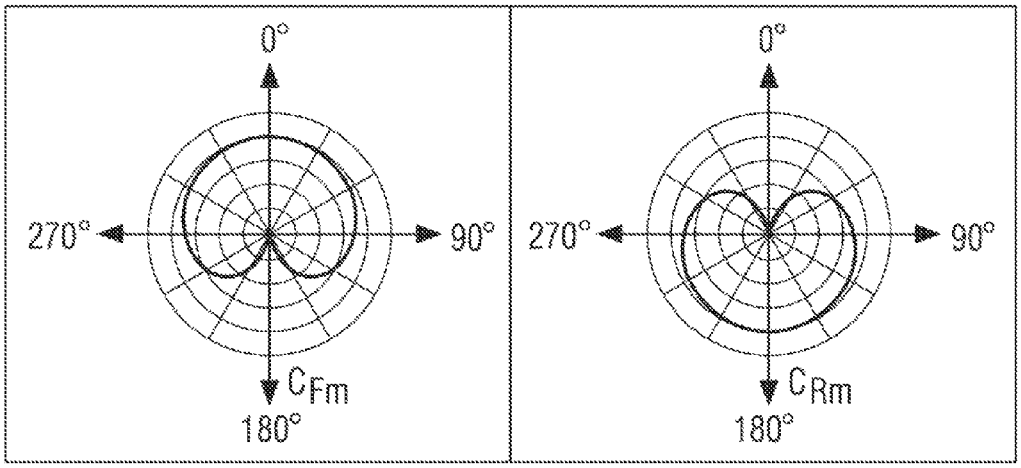
Figure 6D:
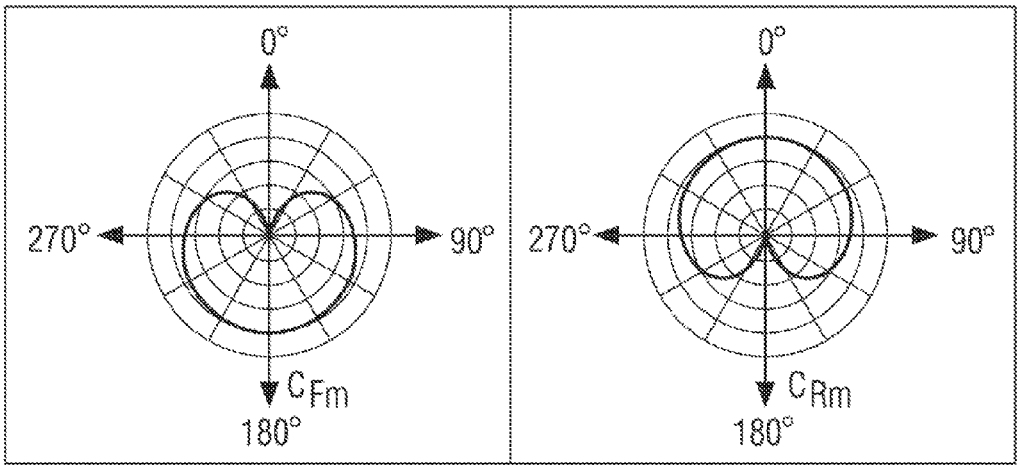

A first parameter "side_select" selects which microphone signal from the binaural DMA is delayed and subtracted and therefore is used to select the direction to which $C_{Fb}(\Omega)$ and $C_{Rb}(\Omega)$ point. Conversely, when "side_select" is set to one, $C_{Fb}(Q)$ points to the right at 90° and $C_{Rb}(\Omega)$ points to the left at 270° (or −90°) as indicated in FIG. 6A. When "side_select" is set to zero $C_{Ft}(\Omega)$ points to the left at 270° (or −90°) ° and $C_{Rb}(\Omega)$ points to the left at 90° as indicated in FIG. 6B. A second parameter "plane_select" selects which microphone signal from the monaural DMA is delayed and subtracted. Therefore, when "plane_select" is set to one, $C_{rb}(Q)$ points to the front plane at 0° and $C_{Rb}(\Omega)$ points to the back plane at 180° as indicated in FIG. 6C. Conversely, when "plane_select" is set to zero, $C_{Fb}(D)$ points to the back plane at 180° and $C_{Rb}(\Omega)$ points to the front plane at 0° as indicated in FIG. 6D.

A method is now illustrated below for calculating a target signal level and a noise signal level, in accordance with the present invention, in the case when a desired acoustic source is at an azimuth $\theta_{steer}$ of 45°. Since the direction of the desired signal $\theta_{steer}$ is known, an estimate of the target signal level is obtained by combining the monaural and binaural directional outputs which mutually have maximum response in the direction of the acoustic source. In this example (for $\theta_{steer}$=45°, the parameters "side_select" and "plane_select" are both set to 1 to give binaural and monaural cardioids and ant-cardioids as indicated in FIGS. 6A and 6C respectively. Based on equation (2), a first monaural directional signal is calculated which is defined by a hypercardioid $Y_1$ and a first binaural directional signal output is calculated which is defined by a hypercardioid $Y_2$. Further, signals $Y_3$ and $Y_4$ are obtained that create notches at 90°/270° and 0°/180°. $Y_1$, $Y_2$, $Y_3$ and $Y_4$ are represented as:

$$\begin{bmatrix} Y \\ Y_2 \\ Y_3 \\ Y_4 \end{bmatrix} = \begin{bmatrix} C_{Fm} \\ C_{Fb} \\ C_{Fm} \\ C_{Fb} \end{bmatrix} - \beta_{hyp} \begin{bmatrix} C_{Rm} \\ C_{Rb} \\ C_{Rm}/\beta_{hyp} \\ C_{Rb}/\beta_{hyp} \end{bmatrix} \tag{13}$$

where $\beta_{hyp}$ is set to a value to create the desired hypercardioid. Equation (13) can be rewritten as:

$$Y = C_{F,1} - \beta_{hyp} C_{R,1} \tag{14}$$

where $Y=[Y_1\ Y_2\ Y_3\ Y_4]^T, C_{F,1}=[C_{Fm}\ C_{Fb}\ C_{Fm}\ C_{Fb}]^T$ and $C_{R,1}=[C_{Rm}\ C_{Rb}\ C_{Rm}/\beta_{hyp}\ C_{Rb}/\beta_{hyp}]^T$.

An estimate of the target signal level can be obtained by selecting the minimum of the directional signals $Y_1$, $Y_2$, $Y_3$ and $Y_4$, which mutually have maximum response in the direction of the acoustic source. In an exemplary embodiment, for signal level, the unit used is power. In this case, an estimate of the short time target signal power $\hat{\Phi}_S$ is obtained by measuring the minimum short time power of the four signal components in Y as given by:

$$\hat{\Phi}_S = \min(\Phi_Y) \tag{15}$$

The estimate of the noise signal level is obtained by combining a second monaural directional signal $N_1$ and a second binaural directional signal $N_2$, that have null placed at the direction of the acoustic source, i.e., that have minimum sensitivity in the direction of the acoustic source. Using the same parametric values of "side_select" and "plane_select", $N_1$ and $N_2$ are calculated as:

$$N = C_{R,2} - \beta_{steer} C_{F,2} \tag{16}$$

where $C_{R,2}=[C_{Rm}\ Cr_{Rb}]^T$ and $C_{F,2}=[C_{Fm}\ F_{Fb}]^T$, $N=[N_1\ N_2]^T$ and $\beta_{steer}$ is set to place a null at the direction of the acoustic source.

In this example, the estimated noise signal level is obtained by selecting the maximum of the directional signals $N_1$ and $N_2$. As before, for signal level, the unit used is power. Thus in this case, an estimate of the short time noise signal power $\hat{\Phi}_D$ is obtained from measuring the maximum short time power of the two noise components in N, and is given by:

$$\hat{\Phi}_D = \max(\Phi_N) \tag{17}$$

Based on the estimated target signal level $\hat{\Phi}_S$ and noise signal level $\hat{\Phi}_D$, a Wiener filter gain $W(\Omega)$ is obtained from:

$$W(\Omega) = \frac{\hat{\Phi}_S}{\hat{\Phi}_S + \hat{\Phi}_D} \tag{18}$$

An enhanced desired signal is obtained by filtering the locally available omni-directional signal using the gain calculated in equation (19). Other directions can be steered to by varying "side_select" and "plane_select".

Figure 7:
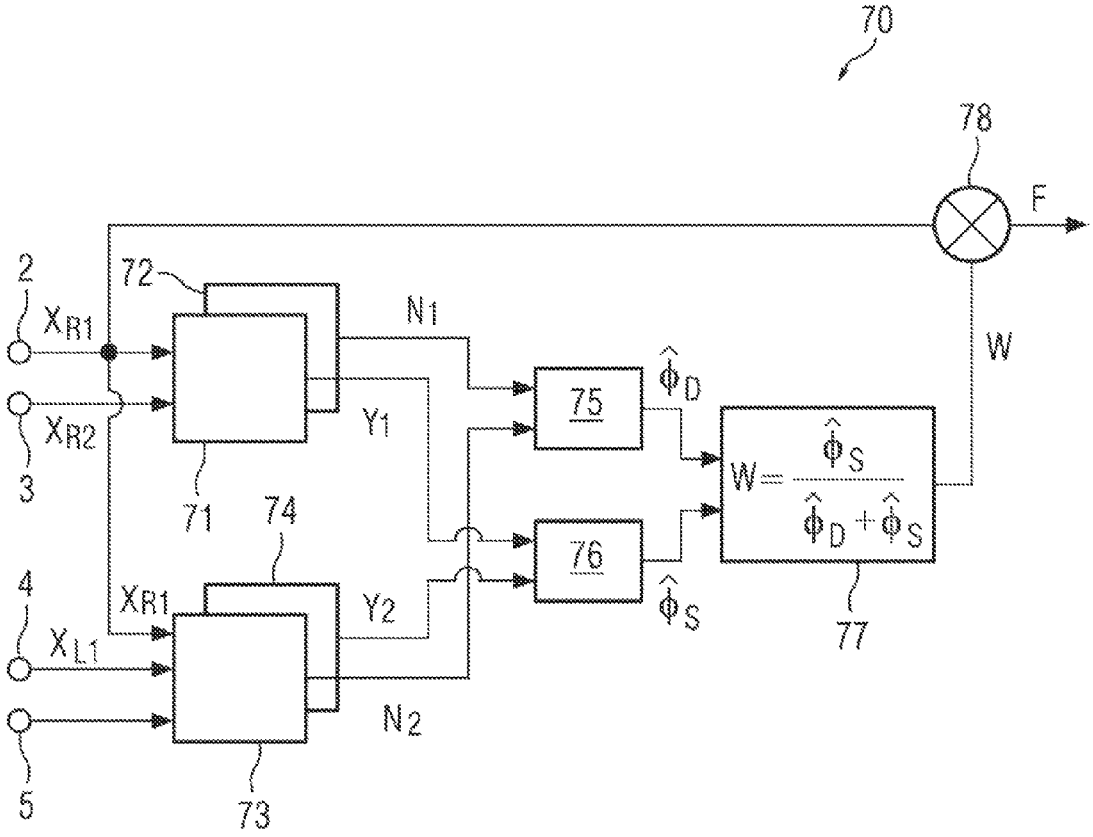
FIG. 7 is a block diagram of a device for direction dependent spatial noise reduction according to one embodiment of the present invention.

FIG. 7 shows a block diagram of a device 70 that accomplishes the method described above to provide direction dependent spatial noise reduction that can be used to focus the angle of maximum sensitivity to a target acoustic source at an azimuth $\eta_{steer}$. The device 70, in this example, is incorporated within the circuitry of the left and right hearing aids shown in FIG. 1. Referring to FIG. 7, the microphone 2 and 3 mutually form a monaural pair while the microphones 2 and 4 mutually form a binaural pair. The input omni-directional signals measured by the microphones 2, 3 and 4 are $X_{R1}[n]$, $X_{R2}[n]$ and $X_{L1}[n]$ expressed in frequency domain. It is also assumed that the azimuth e steer in this example is 45°.

From the input omni-directional signals measured by the microphones, monaural and binaural directional signals are obtained by directional signal processing circuitry. The directional signal processing circuitry comprises a first and a second monaural DMA circuitry 71 and 72 and first and a second binaural DMA circuitry 73 and 74. The first monaural DMA circuitry 71 uses the signals $X_{R1}[n]$ and $X_{R2}[n]$ measured by the monaural microphones 2 and 3 to calculate, therefrom, a first monaural directional signal $Y_1$ having maximum response in the direction of the desired acoustic source, based on the value of $\theta_{steer}$. The first binaural DMA circuitry 73 uses the signals $X_{R1}[n]$ and $X_{L1}[n]$ measured by the binaural microphones 2 and 4 to calculate, therefrom, a first binaural directional signal $Y_2$ having maximum response in the direction of the desired acoustic source, based on the value of $\theta_{steer}$. The directional signals $Y_1$ and $Y_2$ are calculated based on equation (14).

The second monaural DMA circuitry 72 uses the signals $X_{R1}[n]$ and $X_{R2}[n]$ to calculate therefrom a second monaural directional signal $N_1$ having minimum sensitivity in the direction of the acoustic source, based on the value of $\theta_{steer}$. The secand monaural DMA circuitry 74 uses the signals $X_{R1}[n]$ and $X_{L1}[n]$ to calculate therefrom a second binaural directional signal $N_2$ having minimum sensitivity in the direction of the acoustic source, based on the value of $\theta_{steer}$. The directional signals $N_1$ and $N_2$ are calculated based on equation (17).

In the illustrated embodiment, the directional signals $Y_1$, $Y_2$, $N_1$ and $N_2$ are calculated in frequency domain The target signal level and the noise signal level are obtained by combining the above-described monaural and binaural directional signals. As shown, a target signal level estimator 76 estimates a target signal level $\hat{\Phi}_S$ by combining the monaural directional signal $Y_1$ and binaural directional signal $Y_2$, which mutually have a maximum response in the direction the acoustic source. In one embodiment the estimated target signal level $\hat{\Phi}_S$ is obtained by selecting the minimum of monaural and binaural signals $Y_1$ and $Y_2$. The estimated target signal level $\hat{\Phi}_S$ may be calculated, for example, as a minimum of the short time powers of the signals $Y_1$ and $Y_2$. However, the estimated target signal level may also be calculated as the minimum of the any of the following units of the signals $Y_1$ and $Y_2$, namely, energy, amplitude, smoothed amplitude, averaged amplitude and absolute level. A noise signal level estimator 75 estimates a noise signal level $\hat{\Phi}_D$ by combining the monaural directional signal $N_1$ and the binaural directional signal $N_2$, which mutually have a minimum sensitivity in the direction of the acoustic source. The estimated noise signal $\hat{\Phi}_D$ may be obtained, for example by selecting the maximum of the monaural directional signal $N_1$ and the binaural directional signal $N_2$. Alternately, the estimated noise signal $\hat{\Phi}_D$ may be obtained by calculating monaural directional signal $N_1$ and the binaural directional signal $N_2$. As in case of the target signal level, for calculating the estimated noise signal level $\hat{\Phi}_D$, one or multiple of the following units are used, namely, power, energy, amplitude, smoothed amplitude, averaged amplitude, absolute level.

Using the estimated target signal level $\hat{\Phi}_S$ and the noise level $\hat{\Phi}_D$, a gain calculator 77 calculates a Wiener filter gain W using equation (19). A gain multiplier 78 filters the locally available omni-directional signal by applying the calculated gain W to obtain the enhanced desired signal output F that has reduced noise and increased target signal sensitivity in the direction of the acoustic source. Since, in this example, the focus direction (45°) is towards the front direction and the right side, the desired signal output F is obtained my applying the Wiener filter gain W to the omni-directional signal $X_{R1}[n]$ measured by the front microphone 2 of the right hearing aid. Since the response of directional signal processing circuitry is a function of acoustic frequency, the acoustic input signal is typically separated into multiple frequency bands and the above-described technique is used separately for each of these multiple frequency bands.

Figure 8A:
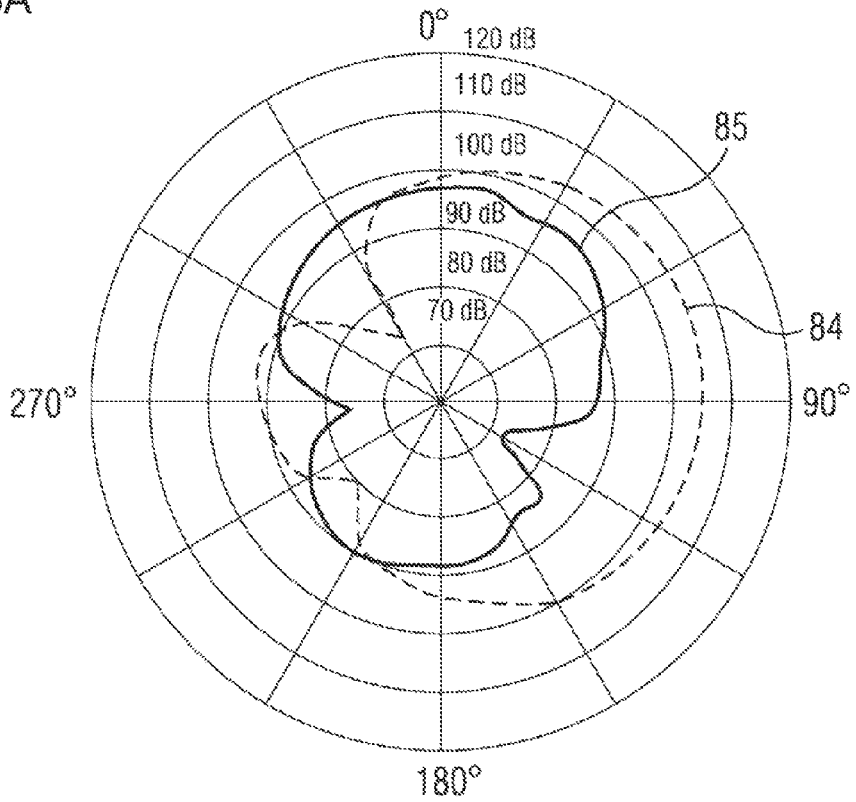
FIG. 8A illustrates an example of how the target signal level can be estimated.
Figure 8B:
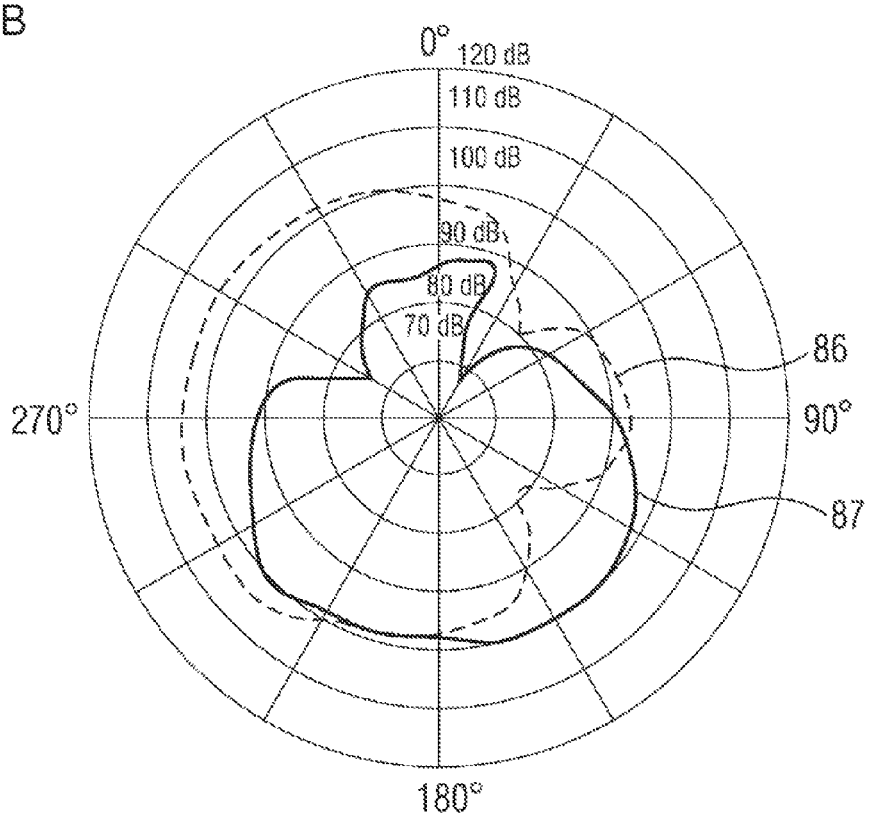
FIG. 8B illustrates an example of how the noise signal level can be estimated.

FIG. 8A shows an example of how the target signal level can be estimated. The monaural signal is shown as solid line 85 and the binaural signal is shown as dotted line 84. As target signal level the minimum of the monaural signal and the binaural signal could be used. Using this criteria for spatial directions from ~345°-195° the monaural signal is the minimum, from ~195°-255° the binaural signal is the minimum etc. FIG. 8B shows an example of how the noise signal level can be estimated. The monaural signal is shown as solid line 87 and the binaural signal is shown as dotted line 86. As noise signal level the maximum of the monaural signal and the binaural signal could be used. Using this criteria for spatial directions from ~100°-180° the monaural signal is the maximum, from ~180°-20° the binaural signal is the minimum etc.

The performance of the proposed side-look beamformer and the proposed steerable beamformer were evaluated by examining the output directivity patterns. A binaural hearing aid system was set up as illustrated in FIG. 1 with two "Behind the Ear" (BTE) hearing aids on each ear and only one signal being transmitted from one ear to the other. The measured microphone signals were recorded on a KEMAR dummy head and the beam patterns were obtained by radiating a source signal from different directions at a constant distance.

Figure 9A:
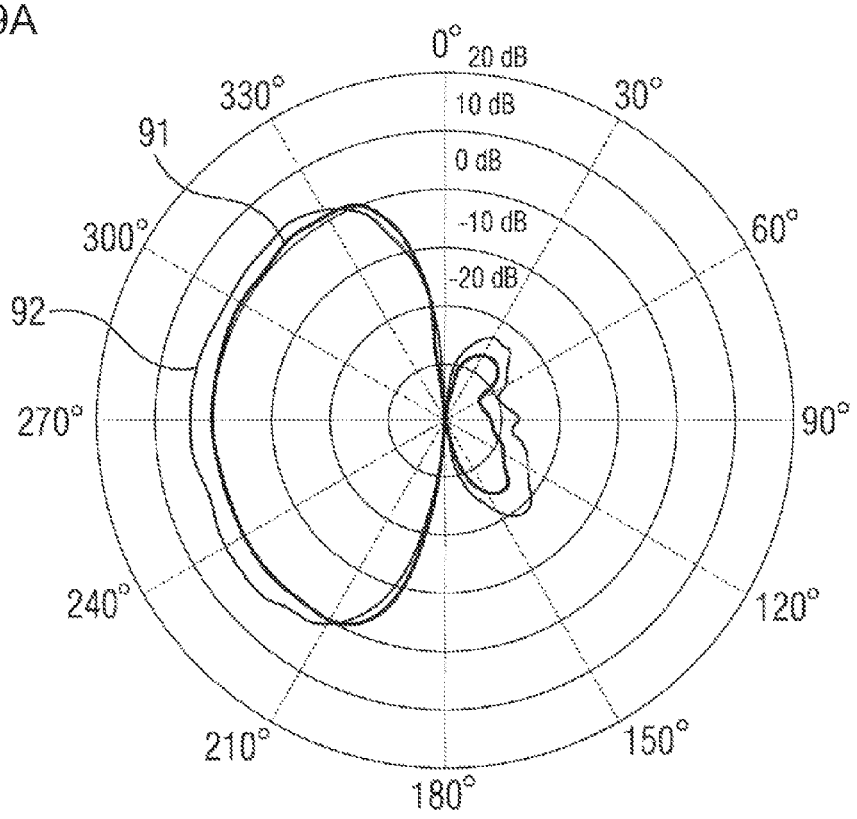
FIGS. 9A-9D illustrate steered beam patterns formed for various test cases.
Figure 9B:
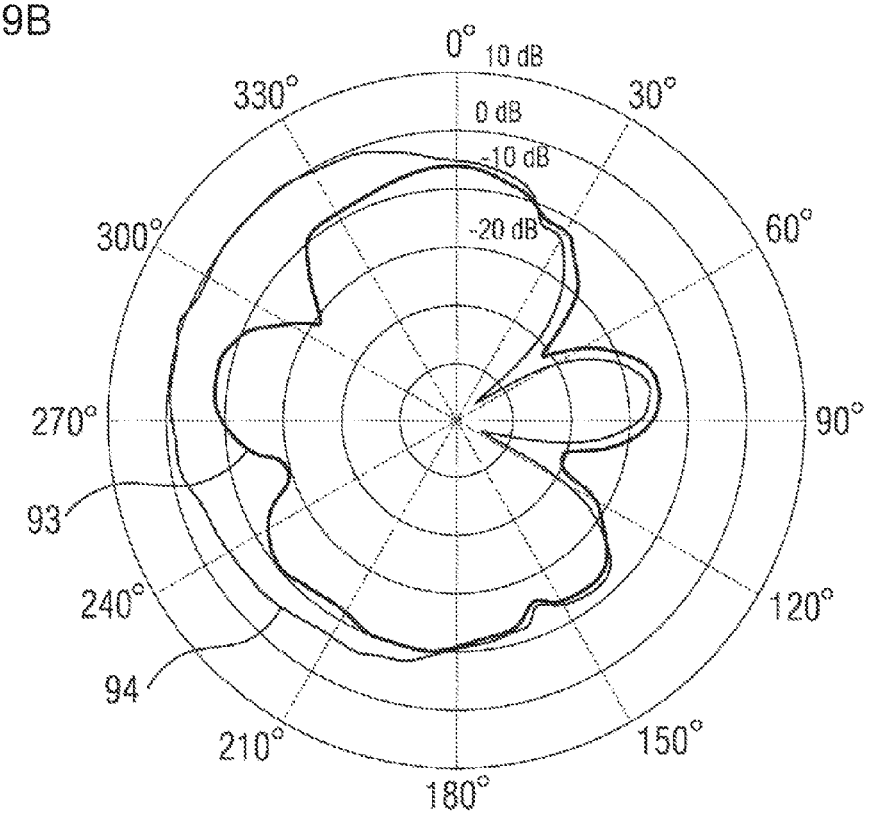

The binaural side-look steering beamformer was decomposed into two subsystems to independently process the low frequencies (≤1 kHz) and the high frequencies (>1 kHz). In this scenario, the desired source was located on the left side of the hearing aid user at −90° (=270° on the plots) and the interferer on the right side of the user at 90°. The effectiveness of these two systems is demonstrated with representative directivity plots illustrated in FIGS. 9A and 9B. FIG. 9A shows the directivity plots obtained at 250 Hz (low frequency) wherein the plot 91 (thick line) represents the right ear signal and the plot 92 (thin line) represents the left ear signal. FIG. 9B shows the directivity plots obtained at 2 kHz (high frequency), wherein the plot 93 (thick line) represents the right ear signal and the plot 94 (thin line) represents the left ear signal. In both FIGS. 9A and 9B, the responses from both ears are shown together to illustrate the desired preservation of the spatial cues. It can be seen that the attenuation is more significant on the interfering signal impinging on the right side of the hearing aid user. Similar frequency responses may be obtained across all frequencies for focusing on desired signals located either at the left (270°) or the right (90°) of the hearing aid user.

The performance of the steerable beamformer is demonstrated for the scenario described referring to FIG. 7, where the desired acoustic source is at azimuth $\theta_{steer}$ of 45°. Since a null is placed at 45°, as per equation (3), $\beta_{steer}$ can be calculated by:

$$\theta_{steer} = \arccos\left(\frac{\beta_{steer} - 1}{\beta_{steer} + 1}\right) \tag{19}$$

$$\Rightarrow \beta_{steer} = \frac{2 - \sqrt{2}}{2 + \sqrt{2}} \tag{20}$$

Figure 9C:
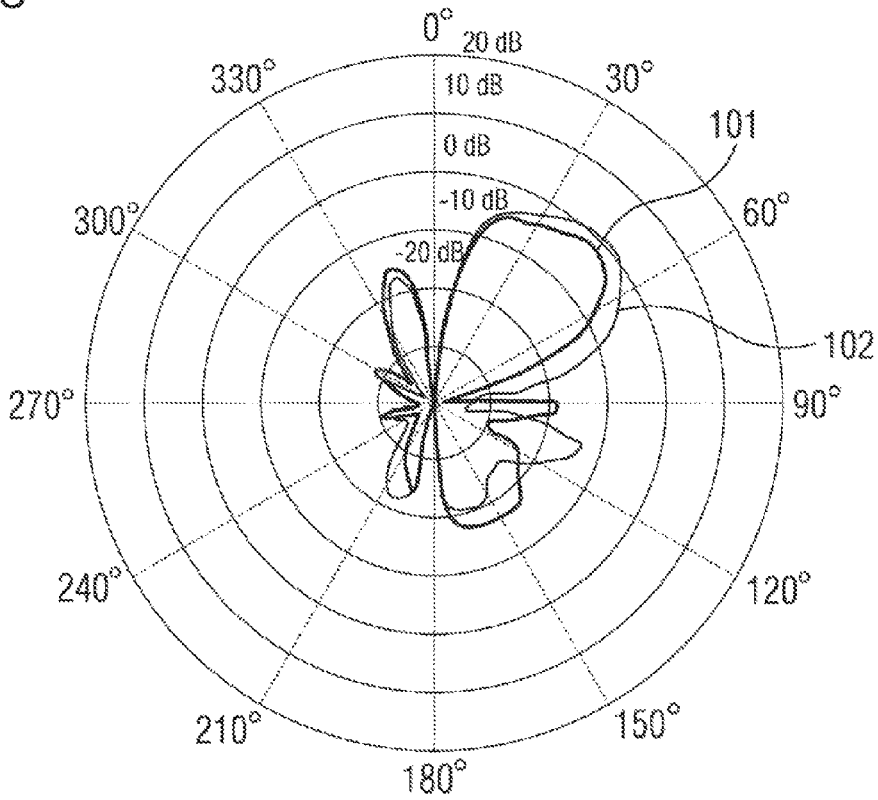
Figure 9D:
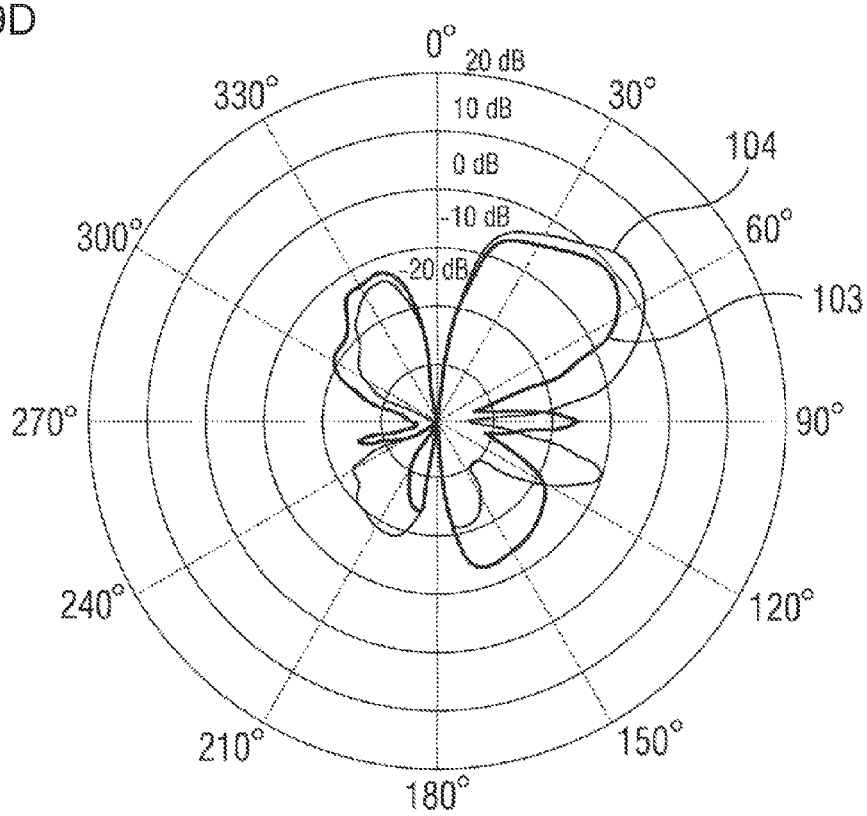

From equations (15) and (17), estimates of the signal power $\hat{\Phi}_S$ and the noise power $\hat{\Phi}_D$ were obtained. FIG. 9C shows the polar plot of the beam pattern of the proposed steering system to 45° at 250 Hz, wherein the plot 101 (thick line) represents the right ear signal and the plot 102 (thin line) represents the left ear signal. FIG. 9D shows the polar plot of the beam pattern of the proposed steering system to 45° at 500 Hz, wherein the plot 103 (thick line) represents the right ear signal and the plot 104 (thin line) represents the left ear signal. As required, the maximum gain is in the direction of $\theta_{steer}$. Since the simulations were performed using actual recorded signals, the steering of the beam can be adjusted to the direction $\theta_{steer}$ by fine-tuning the ideal value of $\beta_{steer}$ from (20) for real implementations.

While this invention has been described in detail with reference to certain preferred embodiments, it should be appreciated that the present invention is not limited to those precine embodiments. Rather, in view of the present disclosure which describes the current best mode for practicing the invention, many modifications and variations would present themselves, to those of skill in the art without departing from the scope and spirit of this invention. The scope of the invention is, therefore, indicated by the following claims rather than by the foregoing description. All changes, modifications, and variations coming within the meaning and range of equivalency of the claims are to be considered within their scope.

The invention claimed is:

1. A method for direction dependent spatial noise reduction, which comprises the following steps:

measuring an acoustic input signal from an acoustic source;

obtaining, from the acoustic input signal, at least one monaural directional signal and at least one binaural directional signal;

estimating a target signal level by combining the at least one monaural directional signal and the at least one binaural directional signal, the at least one monaural directional signal and the at least one binaural directional signal mutually have a maximum response in a direction of the acoustic source; and estimating a noise signal level by combining the at least one monaural directional signal and the at least one binaural directional signal, the at least one monaural directional signal and the at least one binaural directional signal mutually have a minimum sensitivity in a direction of the acoustic source.

2. The method according to claim 1, which further comprises estimating the target signal level by selecting a minimum of the at least one monaural directional signal and the at least one binaural directional signal, which mutually have the maximum response in the direction of the acoustic source.

3. The method according to claim 1, which further comprises estimating the noise signal level by selecting a maximum of the at least one monaural directional signal and the at least one binaural directional signal, which mutually have the minimum sensitivity in the direction of said acoustic source.

4. The method according to claim 1, which further comprises estimating the noise signal level by calculating a sum of the at least one monaural directional signal and the at least one binaural directional signal, which mutually have the minimum sensitivity in the direction of the acoustic source.

5. The method according to claim 1, which further comprises calculating, from the target signal level estimated and the noise signal level estimated, a Wiener filter amplification gain using the formula:

amplification gain=target signal level/[noise signal level+target signal level].

6. The method according to claim 1, which further comprises separating the acoustic input signal into multiple frequency bands and the method is used separately for a multiple of the multiple frequency bands.

7. The method according to claim 1, which further comprises selecting the target signal level and the noise signal level from the group of power signals, energy signals, amplitude levels, smoothed amplitude levels, averaged amplitude levels, and absolute levels.

8. A device for direction dependent spatial noise reduction, comprising:

a plurality microphones for measuring an acoustic input signal from an acoustic source, said plurality of microphones forming at least one monaural pair and at least one binaural pair;

directional signal processing circuitry for obtaining, from the acoustic input signal, at least one monaural directional signal and at least one binaural directional signal;

a target signal level estimator for estimating a target signal level by combining the at least one monaural directional signal and the at least one binaural directional signal, the at least one monaural directional signal and the at least one binaural directional signal mutually have a maximum response in a direction of the acoustic source; and a noise signal level estimator for estimating a noise signal level by combining the at least one monaural directional signal and the at least binaural directional signal, the at least one monaural directional signal and the at least one binaural directional signal mutually have a minimum sensitivity in the direction of the acoustic source.

9. The device according to claim 8, wherein said target signal level estimator is configured for estimating the target signal level by selecting a minimum of the at least one monaural directional signal and the at least one binaural directional signal, which mutually have the maximum response in the direction of the acoustic source.

10. The device according to claim 8, wherein said noise signal level estimator is configured for estimating the noise signal level by selecting a maximum of the at least one monaural directional signal and the at least one binaural directional signal, which mutually have the minimum sensitivity in the direction of the acoustic source.

11. The device according to claim 8, wherein said noise signal level estimator is configured for estimating the noise signal level by calculating a sum of the at least one monaural directional signal and the at least one binaural directional signal, which mutually have the minimum sensitivity in the direction of the acoustic source.

12. The device according to claim 8, further comprising a signal amplifier for amplifying the input acoustic signal based on an Wiener filter amplification gain calculated using the formula:

amplification gain=target signal level/[noise signal level+target signal level].

13. The device according to claim 8, wherein the noise signal level and the target signal level are selected from the group consisting of power signals, energy signals, amplitude signals, smoothed amplitude signals, averaged amplitude signals, and absolute levels.

14. The device according to claim 8, further comprising means for separating the acoustic input signal into multiple frequency bands, wherein the target signal level and the noise signal level are calculated separately for a multiple of the multiple frequency bands.

15. The device according to claim 8, wherein said directional signal processing circuitry further comprises:

a monaural differential microphone array circuitry for obtaining the at least one monaural directional signal; and a binaural differential microphone array circuitry for obtaining the at least one binaural directional signal.

16. The device according to claim 14, wherein said directional signal processing circuitry further comprising a binaural Wiener filter circuitry for obtaining the at least one binaural directional signal, for frequency bands above a threshold value, said binaural Wiener filter circuitry having an amplification gain that is calculated on a basis of signal attenuation corresponding to a transfer function between said binaural pair of microphones.

* * * * *